US008777132B2

(12) United States Patent
Isaacs

(10) Patent No.: US 8,777,132 B2
(45) Date of Patent: Jul. 15, 2014

(54) HAIR BUILDING SOLIDS DISPENSER

(76) Inventor: Elliot Isaacs, London (GB)

( * ) Notice: Subject to any disclaimer, the term of this patent is extended or adjusted under 35 U.S.C. 154(b) by 865 days.

(21) Appl. No.: 12/905,394

(22) Filed: Oct. 15, 2010

(65) Prior Publication Data

US 2011/0089268 A1 Apr. 21, 2011

(30) Foreign Application Priority Data

Oct. 16, 2009 (GB) ..... 0918142.1

(51) Int. Cl.

| | |
|---|---|
| ***B05B 5/00*** | (2006.01) |
| ***F23D 11/32*** | (2006.01) |
| ***A45D 2/00*** | (2006.01) |
| ***A45D 33/02*** | (2006.01) |
| ***A45D 19/00*** | (2006.01) |
| *B05B 5/16* | (2006.01) |
| *B05B 5/03* | (2006.01) |
| *B05B 5/047* | (2006.01) |

(52) U.S. Cl.

CPC ..... *A45D 19/00* (2013.01); *B05B 5/1691* (2013.01); *A45D 33/02* (2013.01); *B05B 5/032* (2013.01); *B05B 5/047* (2013.01)

USPC ..... 239/690.1; 239/650; 239/690; 239/697; 132/221

(58) Field of Classification Search

USPC ..... 239/336, 650, 690, 690.1, 697, 706; 132/201, 212, 221; 222/207, 209, 633; 128/202.25

See application file for complete search history.

(56) References Cited

U.S. PATENT DOCUMENTS

| | | | | |
|---|---|---|---|---|
| 2,069,556 | A * | 2/1937 | O'Connor | 132/298 |
| 3,386,580 | A * | 6/1968 | Grabarczyk | 209/237 |
| 3,713,454 | A * | 1/1973 | Tsukisaka | 132/212 |
| 6,138,671 | A * | 10/2000 | Noakes et al. | 128/202.25 |
| 2008/0223879 | A1 | 9/2008 | Batinkoff et al. | |

FOREIGN PATENT DOCUMENTS

| | | | |
|---|---|---|---|
| EP | 0904843 | A1 | 3/1999 |
| FR | 2063243 | A5 | 7/1971 |
| GB | 1289668 | A | 9/1972 |
| GB | 1522612 | A | 8/1978 |
| JP | 8205928 | A | 8/1996 |
| JP | 2001055611 | A | 2/2001 |
| JP | 2009082158 | A | 4/2009 |
| WO | 96/10459 | | 4/1996 |
| WO | 2009146159 | A1 | 12/2009 |

OTHER PUBLICATIONS

European Search Report, dated Mar. 2, 2011.

Alkam International, UNICO Enterprises. "Nanogen Hair Building Fibers, Nanogen Hair Shampoo, Nanogen Hair Fattener" [online] (c) 2005, Available from: http://webarchive.org/web/20060107014529/http://www.nanothick.com/nanofibers.htm [Accessed Feb. 15, 2010], Figure entitled "actual nanogen fibres" and text entitled "Nanogen Hair Building Fibers".

* cited by examiner

*Primary Examiner* — Ryan Reis

(74) *Attorney, Agent, or Firm* — Crose Law LLC; Bradley D. Crose

(57) ABSTRACT

The invention provides a hair building solids dispenser for storing and dispensing hair building solids comprising first electrostatic charge controller adapted for altering and/or maintaining an electrostatic charge on a surface of at least some of said solids contained within, and/or as dispensed from, said dispenser, wherein at least a substantial portion of the exterior surface of the dispenser comprises substantially electrically non-conductive material, the first electrostatic charge controller being an electrically conductive material for providing an electrical connection between the inside and outside of the dispenser.

14 Claims, 4 Drawing Sheets

HAIR BUILDING SOLIDS DISPENSER

CROSS-REFERENCE TO RELATED APPLICATION

The present non-provisional patent application claims the benefit of priority of foreign Patent Application No. GB0918142.1, which is entitled HAIR BUILDING SOLIDS DISPENSER and which was filed Oct. 16, 2009 which is incorporated in full by reference herein.

FIELD OF THE INVENTION

The present invention relates to a dispenser for storing and dispensing hair building solids.

BACKGROUND OF THE INVENTION

Hair building solids may take different forms. However, typically they are powders and/or fibres. The fibres are relatively narrow (typically less than 200 nm in diameter) and short (typically less than 0.7 mm in length). They typically comprise keratin, rayon or nylon. The solids may be coloured to match a user's hair. The solids are applied to the scalp and/or the hairs of the user typically in an area where the user has suffered hair loss. The solids adhere to the hairs and/or scalp and in the case of the former help to thicken the hairs appearance, and in the case of the latter to camouflage the skin.

The adherence of the solids to the scalp/hairs is typically enabled by means of electrostatic charge, although other means such as adhesives (for example hair spray) may be used. The solids are typically electrostatically non-conductive and thus an electrostatic charge may be built up on their surface. This build up may be due to contact with other surfaces, such as other solids, or the container in which the solids are stored. The built-up charge may last a relatively long time on the surface of the solids until such time as they are discharged to a neutral or oppositely charged surface.

In a known embodiment, the solids are provided in a dispenser which includes a sieve at one end in a similar style to a pepper pot. As the solids are dispensed from the dispenser, by either being shaken out, and/or by gravity, the electrostatic charge on the surface of at least some of the solids is affected such that they naturally adhere to the hair and/or scalp of the user. The charge is affected by the movement of the solids across and past the material making up the sieve, and collision with each other. The charge may be affected by the number, size, shape, concavity, angle, spacing, and pattern of the holes in the sieve, and the dimensions of the sieve itself. The material comprising or at least partially coating the sieve and/or the solids may also affect the charging of the solids. The sieve is a single piece of material that varies in the above characteristics, however it is known only as a single unit, and only used as a single sieve, not multiple sieves.

BRIEF SUMMARY OF THE INVENTION

The present invention describes apparatus and methods for altering and/or maintaining the electrostatic charge on at least some of the solids to improve their performance in terms of their adherence and life expectancy.

In a first aspect the invention provides a hair building solids dispenser for storing and dispensing hair building solids comprising a first electrostatic charge controller adapted for altering and/or maintaining an electrostatic charge on a surface of at least some of said solids contained within, and/or as dispensed from, said dispenser, wherein at least a substantial portion of the exterior surface of the dispenser comprises substantially electrically non-conductive material, the first electrostatic charge controller being an electrically conductive material for providing an electrical connection between the inside and outside of the dispenser.

In one embodiment, the electrostatic charge controller may be provided by apparatus other than a dispensing sieve.

The dispenser may or may not include hair building solids. The dispenser may be a cylindrical container approximately 5 to 15 cm in length and 3 to 5 cm in diameter, although other shapes and sizes are contemplated. The dispenser may include dispensing apparatus for dispensing the solids from the dispenser. The dispensing apparatus may be one or more of a sieve, a pipe, a hole, a spray or any appropriate conduit. The dispensing apparatus may be integral with the container or may be removably attachable to it.

The term "storing" is used herein to include the possibility of the hair building solids only residing in the dispenser for a relatively short time. This may be because the solids are stored elsewhere, only being fed to the dispenser substantially immediately prior to dispensing.

The electrostatic charge controller may be passive and/or active.

The portion of the exterior surface of the dispenser comprising substantially electrically non-conductive material may comprise plastics.

The dispenser may comprise materials which either increase or decrease electrostatic charge build up due to the triboelectric effect.

The electrically conductive material may be a metal strip provided at least partially along an outside of the dispenser, the dispenser including a communicating hole between the inside and outside of said dispenser, the hole being at least partially covered by said metal strip such that at least some of the solids within said dispenser are contactable with said metal strip. The strip may be an example of a passive electrostatic charge controller.

The dispenser may include dispensing apparatus and the metal strip may have an electrical connection to said dispensing apparatus.

The metal strip may have an electrical connection with other electrostatic charge controllers provided at least partially within said dispenser and/or forming part of said dispenser.

The contact between the solids and metal strip may be direct. Alternatively, the contact may be indirect via an intermediate electrically conductive material. The intermediate material may comprise of a conductive filament that may enter the dispenser or connect with at least a portion of the dispenser, such as a sieve. Alternatively the intermediate material may be a conductive portion of the dispenser itself.

The electrically conductive material may comprise materials other than metal. The strip may be 10 to 15 mm wide and linear in form. The strip may be arranged such that when a user holds the dispenser at least a portion of the user's hands contacts with it. Due to electrical connection with the solids inside the dispenser their charge may be affected by the electrostatic state of the user. For instance, any electrostatic charge may be neutralised. This may be useful, in some circumstances, if the type of electrostatic charge on the solids is incorrect and requires "resetting" before being charged to the "correct" and desired type of charge.

The strip may extend around at least a portion of a base of said dispenser. The dispenser may include an insulator for insulating the metal strip, in use or when not in use, from another object with which the dispenser is contactable. The other object may be a table surface on which the dispenser is stored when not in use, an operator's hand, or a docking station. The insulator may be a cover comprising electrically non-conductive material, such as plastics. Alternatively, or additionally, the insulator may be a recess or channel in the dispenser to space apart the metal strip from the other object.

At least a portion of the dispenser may comprise substantially electrically conductive material, said material effecting an electrical connection between the inside and outside of the dispenser. The dispenser may further comprise electrical insulation for electrically insulating at least a portion of said electrically conductive material.

The outside of the dispenser may be at least partially covered or coated in a non-conductive material so that the dispenser may be used with the option of insulating some or all of the conductive material. Additionally, or alternatively, the dispenser may be at least partially coated on the inside so that the conductive material is in contact with the solids to a controlled extent.

The dispenser may comprise a second electrostatic charge controller adapted for altering and/or maintaining an electrostatic charge on a surface of at least some of said solids, the second electrostatic charge controller comprising a dispensing member including a spout, the solids being dispensable via said spout.

The spout may include a structure for increasing the surface area with which solids contact, and/or for promoting collisions between the solids, during dispensing.

The structure for increasing the surface area may include one or more of rifling on the internal surface of the spout, a plate, a ribbed surface, a surface with a series of indentations, a brush, an array of wires, an array of filaments located within said spout, and a sieve. The spout may be electrostatically chargeable. The amount of charge may be affected by the materials comprising the spout. Furthermore, it may be affected by the construction of the spout.

In use, solids may be dispensable via said spout. The spout may be in the form of a tube and may be attached to, or be integral with, the dispenser. The spout may be flexible, semi-rigid or rigid and may comprise more than one portion each having a different rigidity. It may connect to the interior of the dispenser at any point on the perimeter of the dispenser. In one embodiment it may connect to the top of the dispenser. In another embodiment, it may connect substantially towards, or at, the bottom of the dispenser.

The terms "top" and "bottom" refer to the orientation in use. The "bottom" of the dispenser will be the side closest to the ground in use where the solids collect, when not being excited, due to gravity.

Any rifling on the internal surface of said spout may act to spin the air entrained with the solids as it exits the spout. This may encourage contact between the solids and the spout to promote the building up of charge on the solids.

The dispensing member may comprise more than one spout, or a branched spout.

The dispenser may comprise a third electrostatic charge controller adapted for promoting collisions between the solids. This third electrostatic charge controller may be in addition to, or instead of, the second electrostatic charge controller and may include one or more of a plate, a ribbed surface, a surface with a series of indentations, a brush, an array of wires, and an array of filaments possibly located within a container part of the dispenser. The third electrostatic charge controller may be a vibration delivery device. The third electrostatic charge controller may include a piezoelectric material and/or an offset motor. The third electrostatic charge controller may be kinetically or acoustically powered, and/or be powered by a clock-work mechanism and/or a battery, and/or by a source of direct or alternating current.

The third electrostatic charge controller may be electrostatically charged or moved by various apparatus. The vibration delivery device may be arranged to physically excite the solids and/or an object in said dispenser. The third electrostatic charge controller may include apparatus for generating energy and/or movement from environmental radiation such as optical or electromagnetic radiation. The third electrostatic charge controller may provide an electrostatic charge through physical movement. The physical movement apparatus may move an object through and/or across the solids, and/or it may move the solids over and/or though an object, it may also indirectly or directly encourage collision between solids.

Other apparatus, device or structure for the promotion of collisions may be one or more of a fan, a stirrer, a propeller blade, and any other apparatus, device or structure which increases the surface area of any portion of the dispenser with which the solids may come into contact. These may contact with at least some of the solids either when the solids are stored within the dispenser and/or as the solids are dispensed. The components comprising the dispenser may comprise a material that promotes the build up, or discharge, of electrostatic charge due to the triboelectric effect.

The vibration delivery device may be an example of an active electrostatic charge controller.

Any of the above electrostatic charge controllers may be controllable in that the motion or charge is controllable.

At least a portion of the dispenser, including any or all of the electrostatic charge controllers, may be coated with a chemical such as any one or more of an ionic, a non-ionic or an amphoteric surfactant, and a water-resistant agent before and/or during use, such as dispensing, and/or during manufacture.

In one embodiment the dispenser may include a fill indicator device for determining and/or indicating the fill level of the container. This device may utilise sonar, radar, measurement of electrical conductivity, a slider or screw with a moving plate, a light-sensitive cell, a window or transparent panel and possibly a light inside the container, or a device to weigh the contents of container. Alternatively, or additionally, the dispenser may include a usage counter to estimate the fill level, this may take the form of a light-sensitive cell that is uncovered when the dispenser is used, or an electrical contact that is affected when the dispenser is used.

The device for determining and/or indicating the fill level may indicate to the user the fill level or usage count via an appropriate display using indicia, such as an LCD screen, or by a more approximate method such as a gauge, or a series of lights. The device for determining and/or indicating the fill level may comprise two parts, one part for determining the fill level and one party for indicating the fill level. The two parts may communicate with one another directly or indirectly through such apparatus as a microprocessor and an appropriate output device.

Any one or more components comprising the dispenser may comprise a material that promotes the build up of electrostatic charge due to the triboelectric effect. Furthermore, any one or more components comprising the dispenser may comprise a material that is electrically conductive, such as metal.

The dispensing member may be coated before and/or during use, or at manufacture, with a chemical such as any one or more of an ionic, a non-ionic or an amphoteric surfactant, and a water-resistant agent before and/or during use, such as dispensing, and/or during manufacture. The metal strip discussed above may have an electrical connection with the dispensing member.

The dispenser may further comprise an inlet, through which a fluid may enter the dispenser for entraining at least some of the solids. The fluid may be a gas and/or a liquid. The gas may be air. This may enable the use of hair building solids in conditions such as zero or microgravity.

The dispenser may further comprise a pump for providing fluid into the interior of the dispenser. The pump may be hand-powered and/or electrically powered and/or kinetically powered and/or powered by clock-work. The fluid may be introduced from a pressurised source.

Entrained solids may be more easily dispensed in this way and/or have their electrostatic charge altered or maintained by moving them over and/or past portions of the dispenser, and/or increasing the number of collisions between the solids.

The inlet may be arranged to provide the fluid into the interior of the dispenser at a point substantially below the upper surface of the solids, or so that fluid is directed toward the upper surface of the solids. The upper surface of the solids refers to the top of the solids as collected in a layer at the bottom of the dispenser due to gravity, when not being excited.

The dispenser may further comprise a source of ionised fluid or apparatus for ionising said fluid. The ionised fluid may be a gas such as air. The ionised fluid may affect either directly, or indirectly and in combination with other factors, the electrostatic charge on the solids. The ionised fluid may be used before dispensing to alter the charge of the solids and/or may be used additionally to help entrain the fibres for dispensing.

The internal gas pressure inside the dispenser may be substantially higher than the atmospheric pressure outside the dispenser. This may be effected by the introduction of pressurised fluid (such as a propellant), or by increasing the pressure of gas already within the dispenser by, for instance, a reduction of the internal volume or introducing a fluid via the inlet. This higher gas pressure may be used for aiding the dispensing of the solids, and/or for influencing the electrostatic charge on at least some of the solids. This higher gas pressure may be used for aiding the dispensing of the solids, and/or for influencing the electrostatic charge on at least some of the solids and/or enabling use of the solids in zero or microgravity.

The dispenser may provide a chemical emitter, such as a spray, to emit a chemical such as any of an ionic, non-ionic, or amphoteric surfactant or a water-resistant agent onto any of the surfaces of the dispenser, hair, skin or hair building solids.

Alternatively, or additionally, the dispenser may include a radiation emitter to emit radiation onto the dispenser, hair, skin or hair building solids. This radiation may be ultraviolet, or infra-red or a cold laser light to aid sterilisation and/or drying, although other radiations and uses therefor are also contemplated.

The dispenser may comprise an additional device which may be electrostatically charged, electrically conductive, or made of a material that may maintain and/or modify electrostatic charge through the triboelectric effect. Alternatively, or additionally, the additional device may emit a chemical such as any of an ionic, non-ionic, or amphoteric surfactant or a water-resistant agent onto any of the solids, the dispenser, the skin or the hair, or emit a radiation that is beneficial to the hair, skin, or the application of the hair building solids. The additional device may comprise a comb, a handle, and/or a microneedle roller.

The dispenser (with or without said additional device) may include a handle articulated thereto, the combination forming an assembly. The assembly may include irrigation apparatus for irrigating at least a portion of itself and/or the hair and/or scalp of a user, with a fluid. The assembly may include an attachment device for the dispenser to be operated by a user without the need for being held in a hand. The assembly may include equipment which allow multiple dispensers to be used at one time. The assembly may include a heating or refrigeration source, a source of electromagnetic radiation, an infrasonic, sonic, or ultrasonic emitter, a brush or other device for styling purposes and/or to part the hair for better hair building solid application, or any combination of these features.

The dispenser and/or assembly may be used with and/or provided as part of a kit including one or more dispensers, as claimed and/or described herein, a rechargeable power source, a replaceable battery, or a cable for mains electricity with or without a transformer, and a topical treatment including any cosmetically active agent (defined as a compound (natural or synthetic) that has a cosmetic or therapeutic effect on the skin, hair or nails including but not limited to lightening agents, darkening agents, anti-acne agents, shine control agents, anti-microbial agents, anti-inflammatory agents, anti-mycotic agents, anti-parasite agents, external analgesic, sunscreens, photo-protectors, antioxidants, keratolytic agents, detergents or surfactants, moisturisers or humectants, nutrients, vitamins, energy-enhancers, growth factors, anti-perspiration agents, astringents, deodorants, hair-removers, firming agents, anti-callous agents and agents for hair, nail and/or skin conditioning). Of particular interest are curcumin, taurine, plant sterols, pine bark extract, green tea, red tea, white tea, horsetail extract, marine cartilage, caffeine, kieslerde, copper peptides, copper pca, propylgallate, euk-134, copper (II) 3,5-diisopropylsalicylate, minoxidil and other natural or synthetic nitric oxide donators, finasteride, dutasteride, spironolactone, superoxide dismutase (and mimetics), dimethylmethoxy chromanol, catalase mimetics, β-glucan, saw palmetto and other natural and synthetic anti-dihydrotestosterone agents, hydrolysed lupine protein, vitamins c, a, e, b, f, h, k (and derivatives), bacterial filtrates, glucosamine sulphate, an ionic, non-ionic, amphoteric surfactant, a water-resistant agent which may be an acrylate polymer, or any combination of these. The kit may include an assembly as described herein. The kit may be enclosed completely or partially in a case, cover or container for convenient storage and transport of some or all of the articles in the kit.

The dispenser may include apparatus such that it may be adaptable or modifiable to allow the use of more than one dispenser at any one time, in parallel, tandem, or in any other arrangement. This may be achieved by the dispenser including apparatus for interlocking and/or interconnecting with other dispensers.

The dispenser may include an electrostatic charging station, the dispenser and the station including corresponding docking elements for allowing the removable placement of the dispenser into connection with the station, the station further including an electrostatic charge controller adapted for altering and/or maintaining an electrostatic charge on a surface of at least some of said solids contained within said dispenser, and/or for enabling said dispenser to alter and/or maintain an electrostatic charge on a surface of at least some of said solids contained within, and/or as dispensed from, said dispenser, and/or for altering and/or maintaining an electrostatic charge on the hair and/or skin of a user.

Any one or more components comprising the station and/or the dispenser may include a material that promotes the build up of electrostatic charge due to the triboelectric effect.

The station may take the form of a docking station with which the dispenser may interact. The two do not necessarily need to be in physical contact as the station may use induction to induce an electrical charge in a battery in the dispenser, or may rely on other such non-contact interaction. However, in one embodiment the dispenser may dock with the station and be in physical contact therewith. This physical contact may allow the station to alter and/or maintain the electrostatic charge on a surface of at least some of the solids contained within the dispenser. This may be achieved in several different ways.

For instance, the electrostatic charging station may comprise electricity charging apparatus adapted for charging a rechargeable battery. The battery may be provided in the dispenser and may be used to operate mechanical and/or electrical equipment to affect the charge on the solids and/or for other reasons such as providing a light inside the dispenser to illuminate the contents therein.

The station may include mechanical interaction devices for altering the mechanical state of at least part of the dispenser and/or its contents. For instance, the station may wind-up a clock-work mechanism and/or it may drive a stirrer or other such agitation apparatus for interacting with the solids to affect the electrostatic charge thereon. The stirrer may be moved within the container by a moving magnet provided in the station.

The station may comprise a source of fluid that may be ionised which may enter the container or dispensing unit in order to control the electrostatic charge and/or help entrain the solids for dispensing.

The station may be used independently or together with the dispenser to modify the electrostatic charge on the hair and/or skin. The station may comprise a with an electrostatically charge controller for changing the electrostatic charge of the hair and/or skin of the user, as described above with regard to the dispenser. The station may comprise at least a portion of material that affects the electrostatic charge of the dispenser and/or the station and/or the solids by the triboelectric effect. The station may additionally, or alternatively, emit a chemical such as any of an ionic, non-ionic, or amphoteric surfactant or a water-resistant agent onto any of the surfaces of the dispenser, hair, skin, or hair building solids. The station may comprise an emitter for emitting a radiation or chemical that is beneficial to the hair, skin, or the application of the hair building solids to the hair/scalp.

Alternatively, or additionally, the station may comprise a chemical emitter for coating or spraying the dispenser or solids with a chemical such as such as any of an ionic, non-ionic, or amphoteric surfactant or a water-resistant agent. The station may comprise an inlet for filling a reservoir in the dispenser with a similar chemical.

In one embodiment, the station may provide a fill indicator device for determining and/or indicating the fill level of the dispenser. This device may be similar to, or the same as, the one for determining and/or indicating the fill level described above with regard to the dispenser.

The station may be provided as part of a kit that comprises a solution such as an ionic, non-ionic, amphoteric surfactant or a water-resistant agent, one or more dispensers, as claimed and/or described herein, a rechargeable power source, a replaceable battery, or a cable for mains electricity with or without a transformer, and a topical treatment including any cosmetically active agent (defined as a compound (natural or synthetic) that has a cosmetic or therapeutic effect on the skin, hair or nails as defined above with regard to the dispenser. The kit may include an assembly as described herein. The kit may be enclosed completely or partially in a case, cover or container for convenient storage and transport of some or all of the articles in the kit.

In a second aspect, the invention provides a hair building solids dispenser for storing and dispensing hair building solids comprising an electrostatic charge controller adapted for altering and/or maintaining an electrostatic charge on a surface of at least some of said solids contained within, and/or as dispensed from, said dispenser, wherein the electrostatic charge controller is a spout, the solids being dispensable via said spout.

The spout may include a structure for increasing the surface area with which the solids contact, and/or for promoting collisions between the solids, during dispensing, the structure being one or more of rifling on an internal surface of the spout, a plate, a ribbed surface, a surface with a series of indentations, a brush, an array of wires, and an array of filaments.

The spout may include any one or more of the features described above relating to the first aspect of the invention.

In a third aspect, the invention provides a hair building solids dispenser for storing and dispensing hair building solids comprising an electrostatic charge controller adapted for altering and/or maintaining an electrostatic charge on a surface of at least some of said solids contained within, and/or as dispensed from, said dispenser, wherein the electrostatic charge controller includes a structure for increasing the surface area with which the solids contact, and/or for promoting collisions between the solids, during dispensing, said structure including one or more of a plate, a ribbed surface, a surface with a series of indentations, a brush, an array of wires, an array of filaments, and a vibration delivery device.

The vibration delivery device may be kinetically powered or be powered by one or more of a clock-work mechanism, a battery, and a source of direct or alternating current.

The electrostatic charge controller may include a piezoelectric material and/or an offset motor.

The dispenser of the third aspect may include any one or more of the features described above in the first and second aspects of the invention.

In a fourth aspect, the invention provides an electrostatic charging station for use with a dispenser, as described and/or as claimed herein, the station including an electrostatic charge controller adapted for altering and/or maintaining an electrostatic charge on a surface of at least some of said solids contained within said dispenser, and/or for enabling said dispenser to alter and/or maintain an electrostatic charge on a surface of at least some of said solids contained within, and/or as dispensed from, said dispenser, and/or for altering and/or maintaining an the electrostatic charge on the hair and/or skin of a user.

In a fifth aspect, the invention provides an electrostatic charging station, as described herein, together with a dispenser, as described herein.

In a sixth aspect, the invention provides a method of altering and/or maintaining the electrostatic charge on a surface of a hair building solid, comprising the steps of providing a dispenser, as described and/or claimed herein; and operating said dispenser.

The operation of the dispenser may include the step of adding solids to the dispenser.

The operation of the dispenser may be defined as a user picking up the dispenser and holding it in a certain way and/or shaking the dispenser to dispense the solids. Alternatively, or additionally, the user may operate some form of kinetically and/or electrically driven mechanism for affecting the charge on at least some of the solids. This may occur by a stirring of the solids, for instance.

The operation of the dispenser may be undertaken before any solids are dispensed. This may be to neutralise the electrostatic charge on the solids and then to set the charge in whatever way and to whatever strength is required. This change of charge may occur with the solids in the dispenser.

The operation of the dispenser may be undertaken during dispensing of the solids. For instance, the electrostatic charge may be altered or maintained as the solids pass through a dispensing member such as a spout.

The operation of the dispenser may include the step of touching the electrically conductive material. This may be a natural and automatic occurrence due to the way in which the dispenser may be held. The dispenser may include an ergonomically shaped portion in such a way so as to encourage the holding of the dispenser in a particular way. This may then ensure that the metal strip is touched by the user. This may act to alter or maintain the electrostatic charge on the solids within the dispenser.

The operation of the dispenser may include the step of physically exciting the solids. This may be by shaking of the dispenser, or movement of the solids by either hand/or power-assisted in different ways already described herein.

The operation of the dispenser may include the step of pumping a fluid into the interior of the dispenser. The fluid may be supplied by a pressurised container and be conducted to the dispenser. The fluid may be used to pressurise the interior of the dispenser to aid dispensing of the solids. Alternatively, it may be used to entrain the solids and dispense them as the fluid is pumped in. The fluid may be a gas such as air. The fluid may be ionised. The act of pumping fluid into the interior may also affect the electrostatic charge on at least some of the solids. This may be because the pump creates electrostatic charge itself while operating/being operated. Alternatively, or additionally, it may be because the fluid transfers electrostatic charge to, or from, another source of charge. In this way the electrostatic charge on at least some of the solids may be neutralised, or increased or decreased in strength.

The method may include the step of connecting the dispenser to an electrostatic charging station as described and/or claimed herein. Connection may be effected by placing the dispenser immediately adjacent, on, or near the station. The operation of the dispenser may be effected by this connection.

The method may include the step of adding a chemical such as any of an ionic, non-ionic or amphoteric surfactant to any of the solids, the dispenser, the skin or the hair.

The method may include the step of applying a substance that affects the electrostatic charge of one or more of the user's hair, the user's scalp, and said solids.

The method may include the step of applying a substance that affects the ability of one or more of the user's hair, the user's scalp, and said solids to hold an electrostatic charge and/or the type and/or the amount of said charge. The substance may be amphoteric and/or non-ionic or ionic.

In a seventh aspect, the invention provides a method of altering and/or maintaining the electrostatic charge on a surface of a hair building solid, comprising the steps of providing a dispenser, as described and/or claimed herein; providing an electrostatic charging station, as described and/or claimed herein; and operating said station to interact with said dispenser.

In any of the relevant aspects described herein, the electrostatic charge controller may be adapted for imparting an electrostatic charge to at least some of said solids, said controller being provided at least partially within said dispenser, and/or at least a portion of said dispenser comprising said electrostatically chargeable controller. The electrostatic charge controller may be a modification or attachment to a known sieve, or may be a series of sieves.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION OF THE INVENTION

Figure 1:
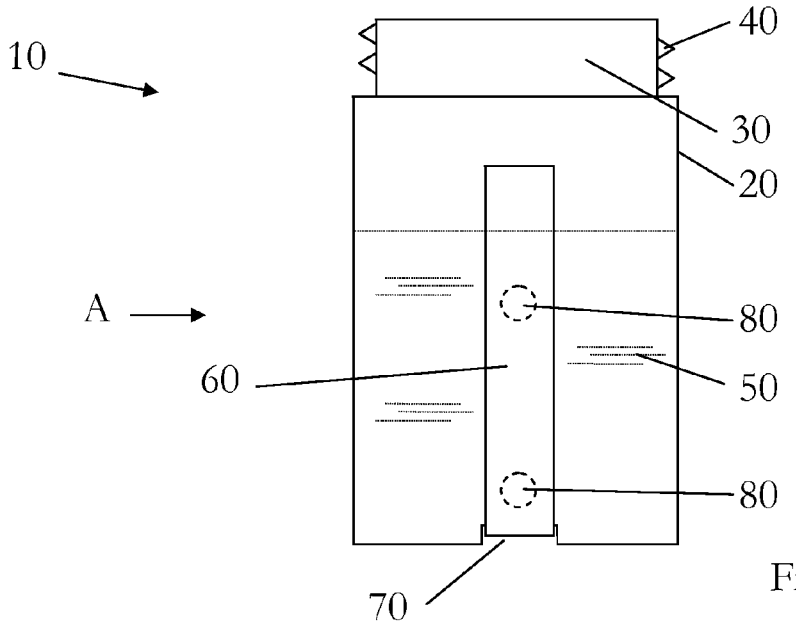
FIG. 1 is an elevational view of a dispenser according to one embodiment of the invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may refer to different embodiments. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

In FIG. 1, a dispenser 10 is shown. The dispenser 10 has a container 20 containing hair building solids 50. The dispenser 10 is substantially cylindrical with a closed lower end and an open upper end. The upper end includes a dispensing member 30. Screw threads 40 are provided on the radially outer surface of the dispensing member 30. These screw threads allow a closure or cap (not shown) including opposed screw threads to be screwed on and off the dispenser 10 to open and close the container 20.

Figure 2:
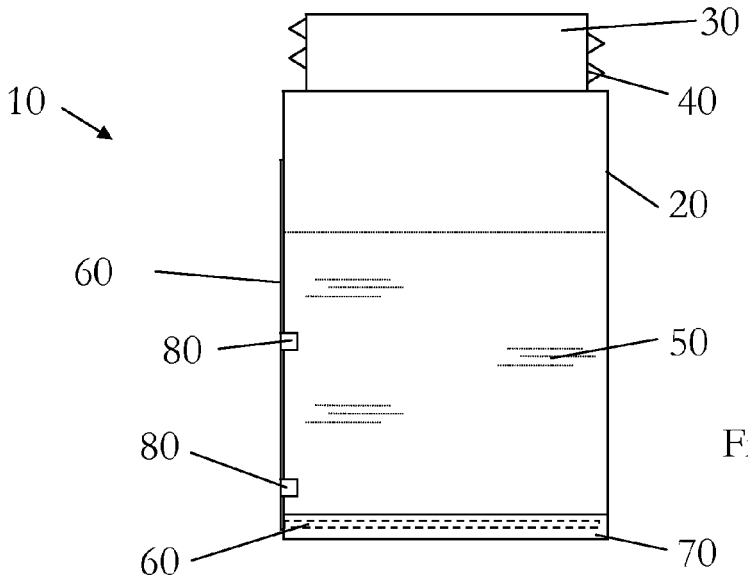
FIG. 2 is a cross-sectional elevation view of the dispenser of FIG. 1.

The container 20 includes a recess, channel or groove in its outer surface and running along a side wall from the upper end to the lower end, or base, of the container 20. The recess 70 extends across the base of the container 20. Within this recess 70 a metal strip 60 is provided. The recess 70 on the base of the container 20 allows the metal strip 60 (refer to FIG. 2 which shows a view of the dispenser 10 of FIG. 1 viewed from the direction of arrow "A") to be distanced from a surface on which the dispenser 10 may be placed, thus insulating it electrostatically.

The container 20 includes two holes 80 passing through its side wall. This allows projections on the radially inner surface of the metal strip (refer to FIG. 2) to contact with the solids 50 provided within the container 20.

This arrangement allows for the electrostatic charge on at least some of the solids 50 within the container 20 to be affected by the electrostatic charge on the metal strip 60. The electrostatic charge on the strip 60 may in turn be affected by a user holding the dispenser 10 and contacting with the metal strip 60 through the user's fingers or hands.

Figure 3:
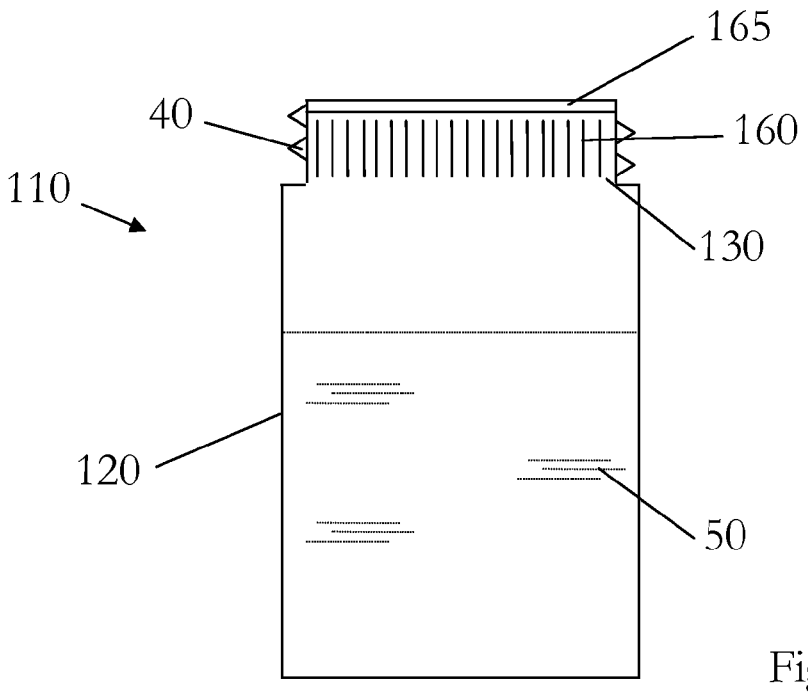
FIG. 3 is an elevational view of a dispenser according to another embodiment of the invention.

The dispenser 110 in FIG. 3 has a different arrangement for affecting the electrostatic charge on at least some the solids 50 in that it comprises a series of plates or baffles 160 provided within the dispensing member 130 arranged at the upper end of the container 120. The dispensing member 130 includes a sieve 165 at the uppermost end for dispensing the solids 50. The plates or baffles 160 may be electrically connected with other electrostatic charge altering or maintaining controllers associated with the dispenser 110 not shown.

As the solids 50 are dispensed from the dispenser 110 via the dispensing member 130 they come into direct or indirect contact with the plates or baffles 160 such that the electrostatic charge thereon is either maintained and/or is altered as desired or controlled.

Figure 4:
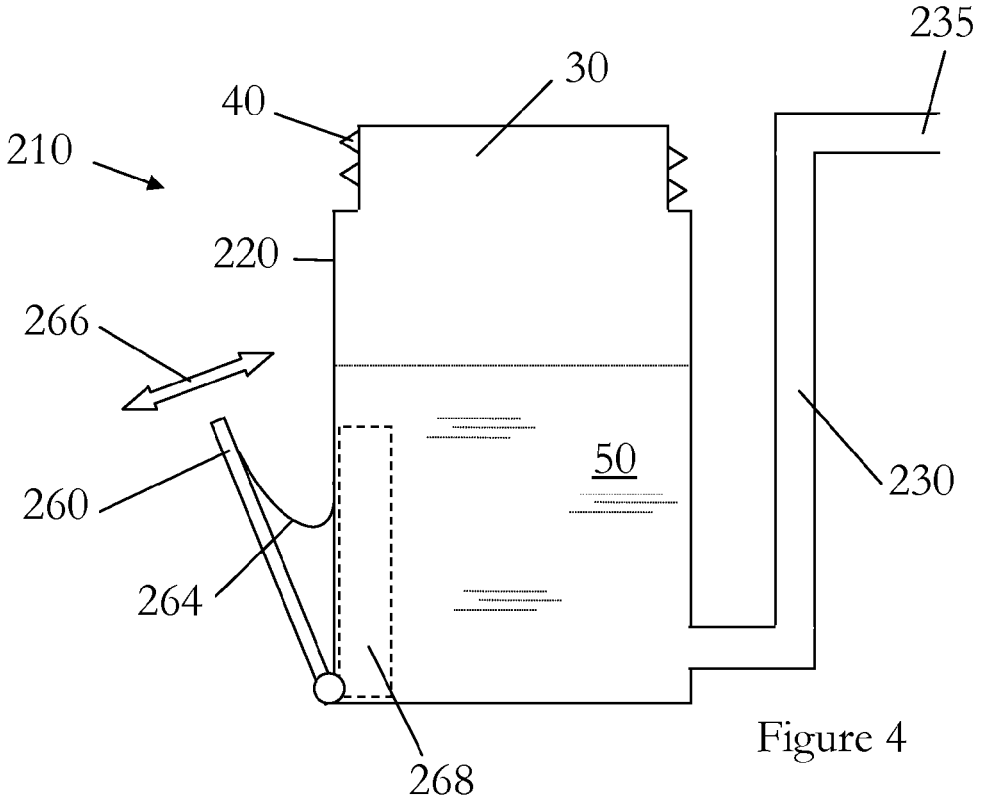
FIG. 4 shows a series of cross-sectional views of different dispensing spouts.

FIG. 4 shows a dispenser 210 having an additional dispensing member 230 in the form of a spout. The spout includes an orifice 235 at its outermost end. The dispenser 210 also includes an open end and dispensing member 30 at the upper end of the container 220. However, this is optional.

The dispenser 210 includes a lever 260 pivoted at its base to a side wall of the container 210. The lever 260 is biased away from the side wall of the container 210 by a biasing device 264, which is shown as a leaf spring in this figure. The lever 260 may be moved reciprocally towards and away from the dispenser 220 in the directions indicated by the arrows 266. This reciprocal movement of the lever 260 drives the unit 268. This unit 268 may be a pump for increasing the gas pressure within the container 220 and/or for exciting the solids 50 and/or for entraining the solids 50 for dispensing via the dispensing member 30 and/or the spout 230. Valves, not shown, may be included for regulating the internal gas pressure and/or the dispensing of the solids 50.

The unit 268 may additionally, or alternatively, alter or maintain the electrostatic charge on at least some of the solids within the container 220. For instance, the unit 268 may move the solids around an object to affect the charge due to the triboelectric effect.

Although the spout 230 is shown connected towards the base of the container 220 it should be understood that it may be connected at any point and may take any shape, form or degree of rigidity.

Figure 5:
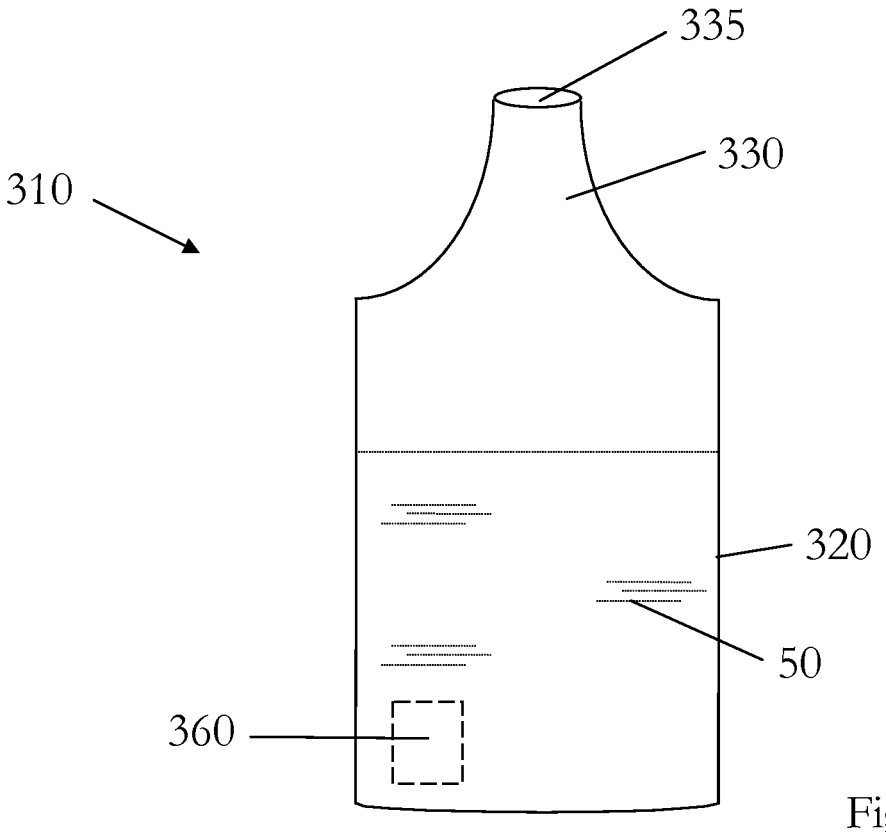
FIG. 5 is an elevational view of a dispenser according to a further embodiment of the invention.

FIG. 5 shows another embodiment of the dispenser 310. This dispenser 310 includes a spout 330 arranged at the uppermost end of the container 320 and has an orifice 335 at the top thereof.

A controller 360 adapted for altering and/or maintaining the electrostatic charge on at least some of the solids 50 contained within the container 320 is provided with the dispenser 310. The controller 360 may be electrically, kinetically or otherwise driven.

This embodiment may include a container 320 comprising a flexible wall portion to allow a user to squeeze/pump/blow the solids 50 out of the spout 330.

Figure 6:
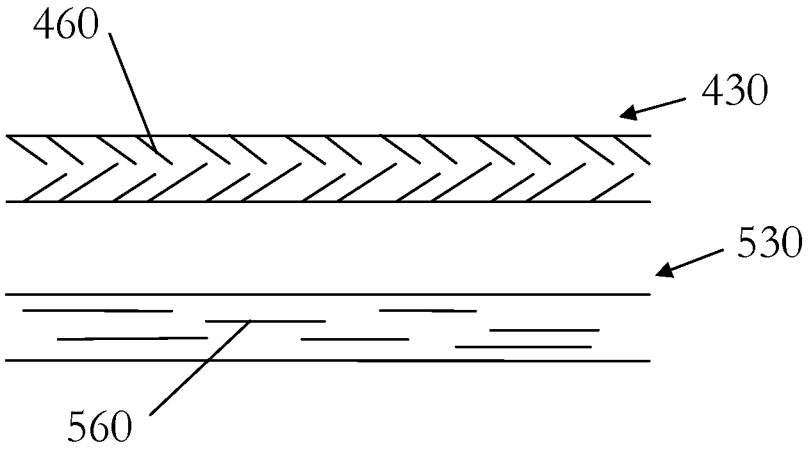
FIG. 6 is a cross-sectional elevation view of a dispenser according to a yet further embodiment of the invention.

Two controllers 430, 530 adapted for altering an/or maintaining the electrostatic charge on at least some of the solids 50 as they are dispensed are shown in FIG. 6. The dispending member 430 is substantially tubular in form and includes an array of baffles or plates 460 provided within its bore. The plates or baffles 460 are arranged to extend from the radially inner surface of the member towards the centre of the bore.

An alternative embodiment 530 is also shown. This includes plates or baffles 560 arranged such that they extend substantially parallel to the longitudinal axis of the bore.

The plates or baffles 460, 560 allow for at least some of the solids 50 to have their electrostatic charge maintained and/or altered as they pass over and across them. The plates or baffles 460, 560 may be electrically connected to other parts of the dispenser 210, 310.

The dispensing member 430, 530 may be connectable to any of the dispensers described and/or claimed herein.

Figure 7:
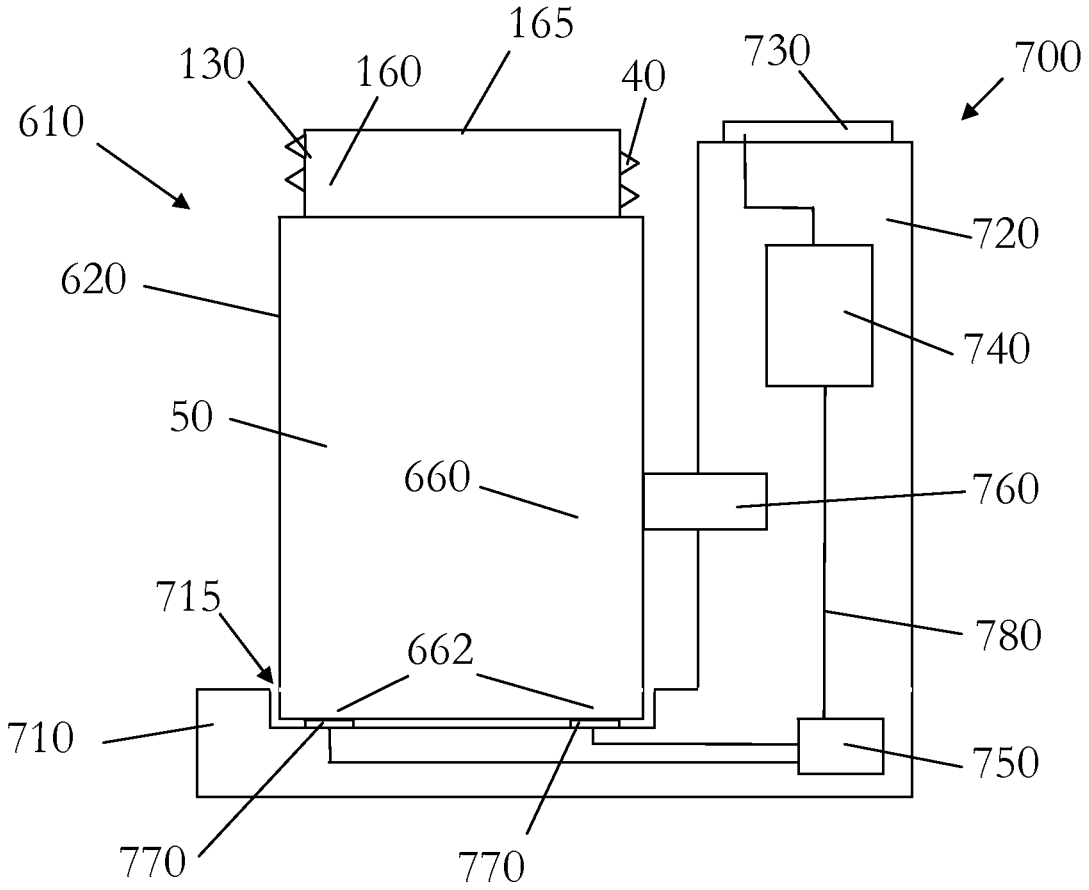
FIG. 7 is a cross-sectional elevation view of a dispenser according to another different embodiment of the invention with a docking station.

FIG. 7 shows a docking station 700 together with a dispenser 610. The docking station 700 may be an electrostatic charging station, or it may be a station for other purposes such as the electrical charging of batteries provided in the dispenser 610.

The station 700 comprises a base part 710, which includes a recess 715 for receiving a dispenser 610 thereon, and a wall part 720 including controls 730 and other components described below.

The dispenser 610 comprises a container 620, a dispensing member 130, screw threads 40, a sieve 165 and baffles 160 as described above with regard to other embodiments of the dispenser. It also includes two electrical contacts 662 provided in the base thereof. Further still, the dispenser 610 includes an electrostatic charge controller adapted 660 for altering and/or maintaining the charge on at least some of the solids 50 provided therein.

The dispenser 610 may be placed on the base part 710 such that it fits within the recess 715. The dispensers 610 and the base part 710 of the station 700 may include alignment apparatus (not shown) to ensure the correct alignment of the electrical contacts 662 with electrical contacts 770 provided in the recess 715. This ensures that electricity may be passed from the station 700 to the dispenser 610. This may allow for the recharging of a battery provided in the dispenser (not shown). This battery may drive the electrostatic charge controller 660.

Alternatively, or additionally the electrical contacts 662, 770 may allow electrostatic charge to be passed to and/or from the dispenser. This may allow for the neutralisation of, or reduction or increase in electrostatic charge on at least some of the solids 50.

The station 700 also includes an interaction device 760 for interacting with the dispenser 610. This interaction may be a physical one in that the device 760 mechanically connects to the electrostatic charge controller 660. This may allow an object 660 to be moved through the solids 50, or to move the solids over an object 50 to alter and/or maintain the electrostatic charge thereon. For instance, the device 760 may connect to a stirrer or a blower 660 in the container 620.

The wall portion 720 of the station 700 includes a CPU 740 with connector 780 connecting the CPU to a control panel 730, a power source (possibly a transformer connected to an external source of electricity, or to a battery), to the electrical contacts 770 and to the interaction device 760.

In use, the dispenser 610 may be docked with the station 700 when not required so as to charge up batteries, and/or to maintain and/or alter the electrostatic charge on at least some of the fibres 50 in the container 620. When required, the dispenser 610 may be removed from the station 700 and operated by the user to dispense the solids 50 onto the region of skin/hair as required. This might be by shaking of the dispenser 610, the operation of a vibrating delivery device, a pump or a stirrer etc.

What is claimed is:

1. A hair building solids dispenser for storing and dispensing hair building solids, the dispenser comprising:

a container for holding hair building solids;

a first electrostatic charge controller being an electrically conductive material providing an electrical connection between the inside and outside of the dispenser, and configured to neutralise an electrostatic charge on the surface of at least some of the solids within the container; and a dispensing member through which hair building solids may be dispensed, configured to apply an electrostatic charge to at least some of the solids as they are dispensed;

wherein a substantial portion of the exterior surface of the dispenser comprises a substantially electrically non-conductive material and wherein the electrically conductive material is a metal strip provided at least partially along an outside of the dispenser, the dispenser including a communicating hole between the inside and outside of said dispenser, the hole being at least partially covered by said metal strip such that at least some of the solids within said dispenser are contactable with said metal strip.

2. The dispenser of claim 1, wherein the metal strip extends around at least a portion of a base of said dispenser, the dispenser including an insulator for insulating the metal strip, in use, from another object with which the dispenser is contactable.

3. The dispenser of claim 2, wherein the insulator is a cover comprising electrically non-conductive material and/or a recess in the dispenser to space apart the metal strip from the other object.

4. The dispenser of claim 1 further comprising a second electrostatic charge controller adapted for altering and/or maintaining an electrostatic charge on a surface of at least some of said solids, said second electrostatic charge controller including a spout, the solids being dispensable via said spout.

5. The dispenser of claim 4, wherein the spout includes a structure adapted for increasing the surface area with which solids contact, and/or for promoting collisions between the solids, during dispensing.

6. The dispenser of claim 5, wherein the structure for increasing the surface area includes one or more of rifling on the internal surface of the spout, a plate, a ribbed surface, a surface with a series of indentations, a brush, an array of wires, and an array of filaments.

7. The dispenser of claim 4, wherein the spout is electrostatically chargeable.

8. The dispenser of claim 1, comprising a second electrostatic charge controller adapted for altering and/or maintaining an electrostatic charge on a surface of at least some of said solids by promoting collisions between the solids.

9. The dispenser of claim 8, wherein said second electrostatic charge controller includes one or more of a plate, a ribbed surface, a surface with a series of indentations, a brush, an array of wires, and an array of filaments.

10. The dispenser of claim 8, wherein said second electrostatic charge controller is a vibration delivery device.

11. The dispenser of claim 10, wherein said second electrostatic charge controller includes a piezoelectric material and/or an offset motor.

12. The dispenser of claim 8, wherein said second electrostatic charge controller is kinetically powered, and/or is powered by a clock-work mechanism and/or a battery, and/or by a source of direct or alternating current.

13. The dispenser of claim 1 comprising an electrostatic charging station, the dispenser and the station including corresponding docking elements adapted to allow the removable placement of the dispenser into connection with the station, the station further including a second electrostatic charge controller adapted for altering and/or maintaining an electrostatic charge on a surface of at least some of said solids contained within said dispenser, and/or for enabling said dispenser to alter and/or maintain an electrostatic charge on a surface of at least some of said solids contained within, and/or as dispensed from, said dispenser, and/or for altering and/or maintaining an electrostatic charge on the hair and/or skin of a user.

14. The dispenser of claim 1, wherein any one or more components comprising the dispenser include a material that promotes the build up of electrostatic charge due to the triboelectric effect.

* * * * *